United States Patent [19]

McCabe

[11] Patent Number: 4,655,122

[45] Date of Patent: Apr. 7, 1987

[54] AERODYNAMIC SHAPE WITH IMPROVED LIFT CHARACTERISTICS

[76] Inventor: Francis J. McCabe, 239 Hastings Ct., Doylestown, Pa. 18901

[21] Appl. No.: 866,873

[22] Filed: May 23, 1986

Related U.S. Application Data

[63] Continuation of Ser. No. 428,621, Sep. 30, 1982, abandoned.

[51] Int. Cl.[4] ..... F24F 13/15

[52] U.S. Cl. ..... 98/119; 98/116; 137/512.1

[58] Field of Search ..... 98/110, 116, 119, 121.2; 137/512.1, 513, 527.8

[56] References Cited

U.S. PATENT DOCUMENTS

| | | | |
|---|---|---|---|
| 345,693 | 7/1886 | Hayes . | |
| 345,694 | 7/1886 | Hayes . | |
| 1,550,813 | 8/1925 | Johnson | 98/119 |
| 2,759,573 | 8/1956 | Schwab | 189/62 |
| 3,204,548 | 9/1965 | McCabe | 98/119 |
| 3,327,764 | 6/1967 | McCabe | 160/5 |
| 3,374,576 | 3/1968 | Duclon et al. | 49/81 |
| 3,381,601 | 5/1968 | McCabe | 98/121.2 |
| 3,487,768 | 1/1970 | Watson | 98/107 |
| 3,540,154 | 11/1970 | Claudio | 49/91 |
| 3,581,650 | 6/1971 | McCabe | 98/110 |
| 3,584,566 | 6/1971 | McCabe | 98/110 |
| 3,605,603 | 9/1971 | McCabe | 98/110 |
| 3,648,328 | 3/1972 | McCabe | 16/178 |
| 3,682,084 | 8/1972 | Tarnoff | 98/110 |
| 3,738,254 | 6/1973 | Rout | 98/119 |
| 3,741,102 | 6/1973 | Kaiser | 98/110 |
| 3,833,989 | 9/1974 | McCabe | 29/157 R |
| 3,908,529 | 9/1975 | McCabe | 98/110 |
| 4,185,657 | 1/1980 | McCabe | 137/601 |
| 4,185,658 | 1/1980 | McCabe | 137/601 |
| 4,205,706 | 6/1980 | Jasensky | 138/89 |
| 4,277,870 | 7/1981 | McCabe | 29/157 R |

OTHER PUBLICATIONS

Back Draft Damper Catalog Sheet (Prefco Products, Inc.).

*Primary Examiner*—Harold Joyce

*Attorney, Agent, or Firm*—Benasutti and Murray

[57] ABSTRACT

An improved aerodynamic shape comprises an essentially planar face portion and leading and trailing edges associated with opposing ends of the face portion to develop a cross-sectionally inverted, pan-shaped enclosure. In conjunction with a damper including a frame and one or more blades pivoted for rotation within the frame, blades provided with the aerodynamic shape of the invention develop increased lift when forced open by escaping air, permitting the blades to be constructed of relatively heavy gauge materials without comprising damper efficiency.

20 Claims, 6 Drawing Figures

AERODYNAMIC SHAPE WITH IMPROVED LIFT CHARACTERISTICS

This is a continuation of application Ser. No. 428,621, filed Sept. 30, 1982, now abandoned.

BACKGROUND OF THE INVENTION

The present invention relates generally to an aerodynamic shape which provides improved lift characteristics, and in particular, to the use of such an aerodynamic shape in conjunction with an air damper to achieve improved operational characteristics.

In general, air dampers commonly referred to as backdraft dampers are used to permit the flow of air through a ventilation system in one direction only, to ventilate an area of a structure while preventing the entry of air from the exterior of the structure being ventilated during normal operating conditions. In the development of such backdraft dampers, workers skilled in the art have long sought to develop a device having blades which are easily moved from their normally closed position wherein the damper blades combine to form an effective air seal, to an open position which permits the unimpeded flow of air through the device when ventilation is necessary. The development of such a backdraft damper would permit vented air to pass from the interior of a building to the exterior environment while precluding wind, backdraft, rain, dust, smoke or obnoxious fumes from entering the interior of the building through the damper.

To achieve the foregoing results, a variety of backdraft dampers have been designed which primarily operate in response to the differential pressure developed across the damper when ventilation is to be performed. During normal operating conditions, the blades of such dampers combine to develop an efficient seal which is capable of preventing the passage or leakage of air, in the wrong direction, from between the closed blades of the damper. When ventilation is needed, the blades of such dampers readily open in a manner which reduces resistance to the flow of air through the damper, to maximize its ventilating capabilities. Two such backdraft dampers are described in my prior U.S. Pats. Nos. 3,908,529 and 3,381,601, for example. In addition, reference is made to U.S. Pats. Nos. 3,833,989; 3,327,764; 3,581,650 and 3,605,603, which show other constructions which may be used to produce a series of blades which are pivoted for rotation within a frame to develop a backdraft damper having adequate operational characteristics.

Although the foregoing devices serve to achieve the required operational characteristics of a backdraft damper, it has been found that such devices are capable of still further improvement. For example, to assure that the damper blades operate properly and do not flex during operation of the damper, the blades of each of the foregoing devices must generally be formed of relatively thick or heavy gauge materials. This is particularly so as the size of the damper is increased, necessitating the use of still larger blades. The weight of such damper blades tends to compromise the ability of the damper blades to quickly and fully open, accordingly limiting the ability of the backdraft damper to ventilate an area by limiting the flow of air through the damper.

In an effort to overcome this, attempts have been made to develop damper blades having improved aerodynamic characteristics which assist in lifting the blades as air passes through the damper. One example of such a damper construction may be found in my prior U.S. Pat. No. 3,204,548. Such aerodynamically shaped blades tend to compensate for the weight of the materials which are used to construct the damper blades, permitting dampers constructed of such materials to ventilate increased volumes of air from a structure without sacrificing damper integrity. However, again, such damper constructions are capable of still further improvement. In particular, it is desirable to develop a damper blade having still further improved lift capabilities, to further improve the efficiency of the damper. Further in this regard, since the flow of air through such dampers often occurs at relatively low velocities, the aerodynamic shape developed should be capable of providing such improved lift characteristics, even at low speeds, to further improve the efficiency and range of the damper. Moreover, it is desirable to develop a damper construction having increased simplicity in construction, to decrease the cost of manufacturing such dampers.

SUMMARY OF THE INVENTION

In accordance with the present invention, an improved aerodynamic shape is provided which is adaptable for use in conjunction with a variety of different applications, including damper applications. This aerodynamic shape generally includes an essentially planar surface portion separating leading and trailing edges which depend from the planar surface portion in specified manner to form a cross-sectionally inverted, pan-shaped structure. By appropriately shaping the structural elements comprising this aerodynamic shape, the desired improved lift characteristics are achieved.

For use in conjucntion with backdraft damper applications, the terminating end of the trailing edge of the aerodynamic shape is provided with a sealing member capable of engaging appropriate portions of the damper assembly to provide an appropriate seal when the damper is closed. The terminating end of the leading edge of the aerodynamic shape is provided with an appropriate hinge which is capable of engaging corresponding hinge elements associated with the frame to align and retain the damper blades in position and complete the damper structure. By providing the damper with blades having improved aerodynamic lift capabilities, significantly improved results are achieved.

Accordingly, it is a primary object of the present invention to develop an aerodynamic shape having improved lift characteristics.

It is also an object of the present invention to provide a damper structure which includes one or more blades having an aerodynamic shape capable of providing improved lift characteristics, to assist in lifting and opening of the blades during ventilation and thereby increase the volume of air which can be ventilated from the system.

It is also an object of the present invention to provide an improved damper structure which includes one or more blades having an improved aerodynamic shape capable of providing improved lift characteristics so that significant volumes of air may be ventilated when indicated and so that the blades may be constructed of materials which provide the blades with adequate structural integrity without comprising damper operation.

These and other objects will become apparent from the following detailed description, taken in conjunction with the following illustrations.

BRIEF DESCRIPTION OF THE DRAWINGS

In the several views provided, like reference numerals denote similar structure.

DETAILED DESCRIPTION OF THE PREFERRED EMBODIMENT

Figure 1:
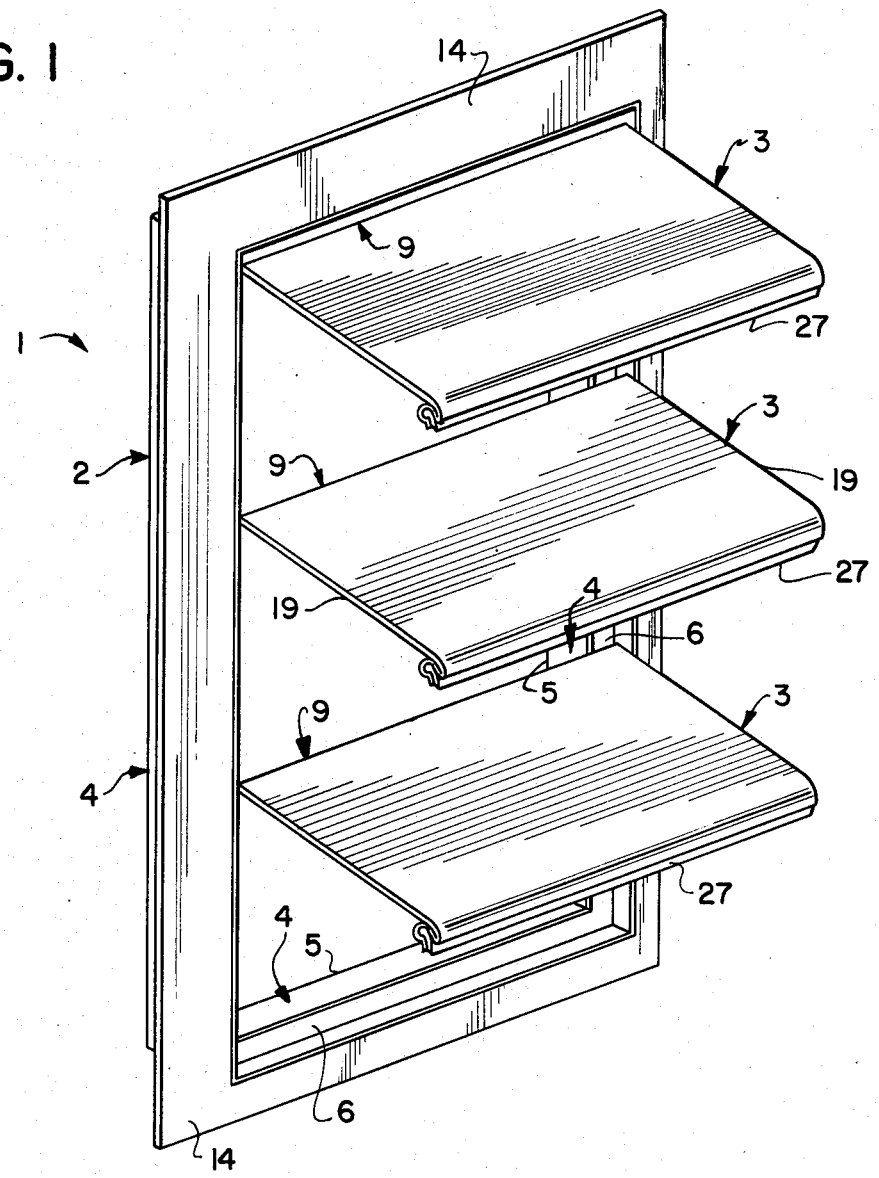
FIG. 1 is an isometric view of a damper incorporating a series of blades having the improved aerodynamic shape of the present invention, showing the blades in the open position.

Although specific forms of the invention have been selected for illustration in the drawings, and the following description is drawn in specific terms for the purpose of describing these forms of the invention, this description is not intended to limit the scope of the invention which is defined in the appended claims.

FIG. 1 illustrates a backdraft damper 1 which generally comprises a peripheral frame 2 and a plurality of blades 3 which are pivotally disposed within the frame 2 to permit the blades 3 to freely open and close in response to the flow of air through the damper in the appropriate direction. It will be understood that a variety of different damper constructions may be used in forming the damper 1 illustrated in FIG. 1 in accordance with the present invention. For example, reference is made to my prior U.S. Pats. Nos. 3,908,529; 3,833,989; 3,605,603; 3,581,650; 3,381,601; and 3,327,764, each of which illustrate damper constructions of this type. It will, of course, be understood that the basic construction of the damper 1 may be varied to suit a particular application as needed, including variations in the size of the damper frame as well as the size of the damper blades, and the number of damper blades used in conjunction with the damper construction selected.

To assist in the understanding of the present invention, reference is made to FIGS. 1 and 2 of the drawings, which show one illustrative damper construction which may be provided with damper blades of improved aerodynamic shape in accordance with the present invention, as will be more fully described below. It will be seen that the frame 2 of the damper 1 generally comprises a plurality of sides 4 which terminate along an inner flange 5 and an outer flange 6 as shown. The inner flange 5 and sides 4 of the damper 1 are preferably configured to cooperate with the structure (not shown) with which the damper 1 is to be used. For example, in conjunction with an installation wherein the damper 1 is to extend through the wall of a building, the building would be provided with a suitable opening sized to receive and engage the sides 4 and inner flange 5 of the damper frame 2 in the conventional manner. The frame 2 is additionally provided with a facing plate 14 which extends transversely outwardly from the outer edges of the sides 4 of the frame 2, and is preferably provided to engage the periphery of the opening in the structure which has been fitted with the damper 1 to provide the installation with a finished appearance. It will, of course, be understood that a variety of other damper installations may also be performed, as desired.

The outer flange 6 is provided with a plurality of hinge elements 7 which are positioned at spaced intervals along opposing transverse edges of the flange 6 as shown. Each of the hinge elements 7 generally comprise a curved portion 8 which is preferably formed as part of the flange 6. Opposing pairs of hinge elements 7 are then used to engage a hinge 9 associated with each of the blades 3. The hinge 9 preferably extends transversely across the uppermost edge of each blade 3 and is again provided with a curved portion 10 which complimentally engages the curved portion 8 of the hinge elements 7. The foregoing components combine to permit the blades 3 to pivot with respect to the frame 2 when opening of the damper 3 is called for. As indicated in FIGS. 2 and 3, the hinge arrangement previously described permits each of the blades 3 to pivot from a fully closed position to an open position wherein the damper blades 3 are substantially parallel to the flow of air through the damper, thereby reducing air flow resistance through the damper.

Each of the blades 3 are additionally preferably provided with a bracket 11 which is attached to the blade surface using appropriate mechanical fasteners such as rivits, etc. The brackets 11 are preferably attached to upper portions of each blade 3, preferably just below the hinge 9, and are preferably in alignment with one another so that a connecting rod 12 may be pivotally attached to and between the brackets 11 at the pivot points 13. Use of this assembly is preferred so that the blades 3 will open substantially simultaneously as air flows through the damper, achieving a more uniform flow through the damper in the open position.

Figure 2:
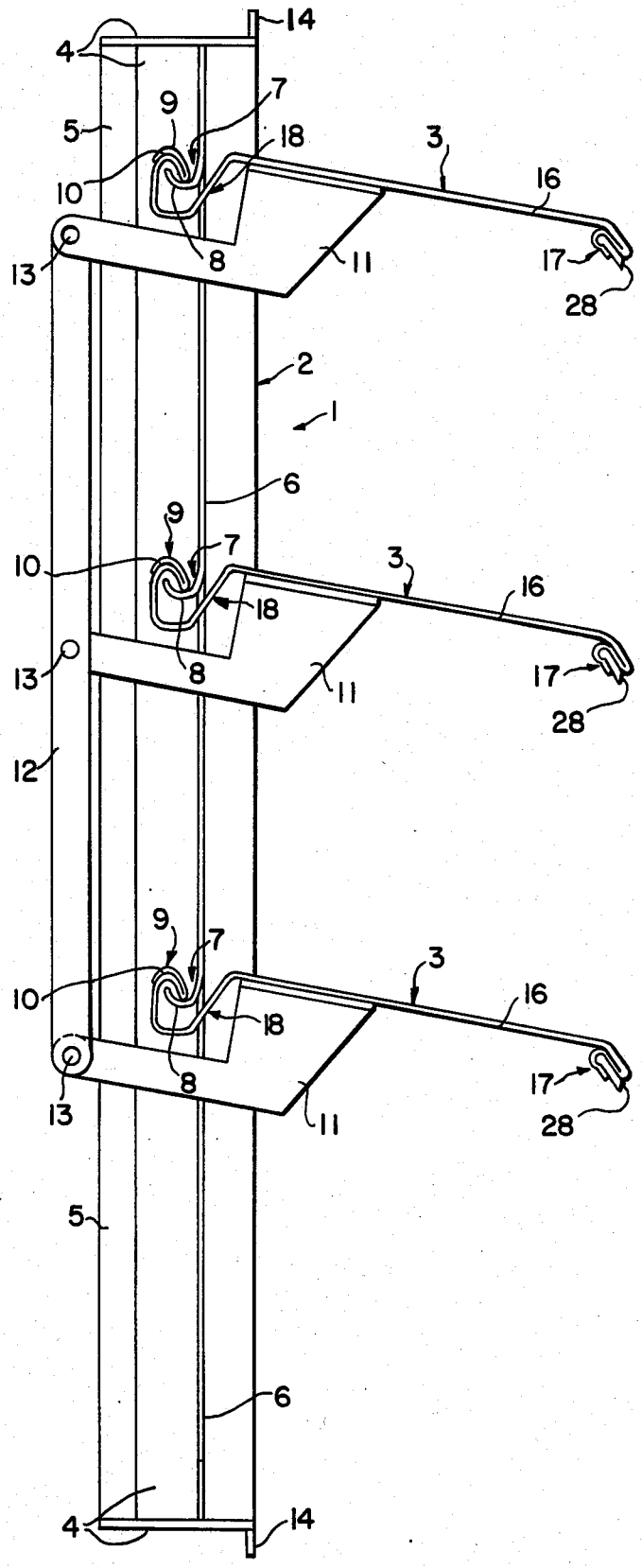
FIG. 2 is a cross-sectional view of the damper of FIG. 1, taken along line 2—2.
Figure 3:
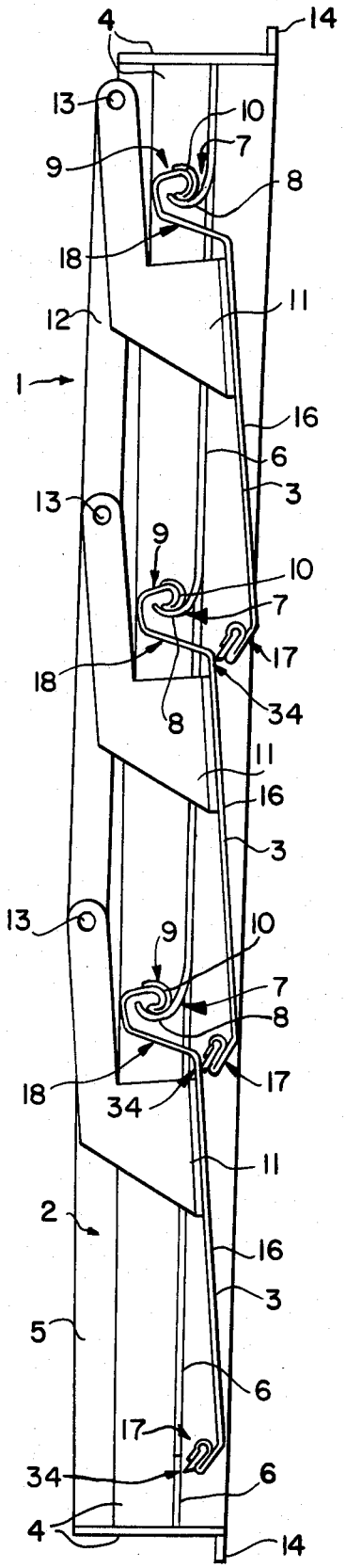
FIG. 3 is a cross-sectional view similar to the view of FIG. 2, but which illustrates the blades of the damper in the closed position.
Figure 4:
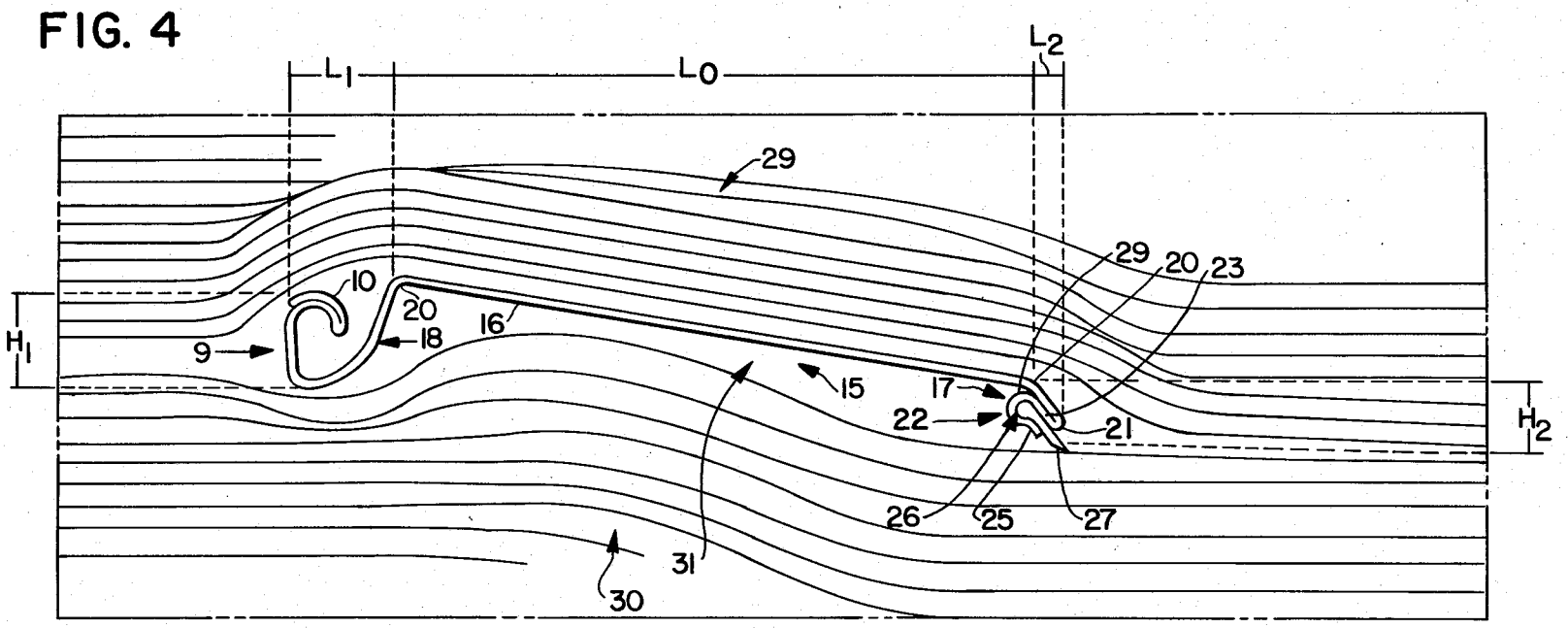
FIG. 4 is a cross-sectional view of one of the blades of the damper of FIG. 1, and also diagrammatically illustrates the flow of air across the blade.

In accordance with the present invention, each of the blades 3 are provided with an aerodynamic shape 15 which is best illustrated in FIGS. 2–4. The aerodynamic shape 15 generally comprises, in cross-section, an essentially planar face portion 16 the opposing ends of which are provided with a leading edge 18 and a trailing edge 17 as shown. The essentially planar face portion 16 essentially forms the face of each of the blades 3, and is intended to include surfaces which are completely planar as well as surfaces which include gradual curvatures yet which are essentially planar in appearance. The opposing lateral edges 19 of each face portion 16 will normally be caused to rest on the outer flange 6, thereby providing a seal between the lateral edges 19 and the frame 2 when the blades 3 are in the closed position. The leading edge 18 and trailing edge 17 depend from opposing longitudinal edges 20 of the face portion 16, to form a cross-sectionally inverted, pan-shaped structure as shown.

As best illustrated in FIG. 4, the trailing edge 17 depends outwardly and downwardly from one of the edges 20 of the face portion 16, as will be more fully described below. Attached to the terminating end 21 of the trailing edge 17 is a seal engaging member 22 which generally comprises a first planar portion 23 which is folded back upon the trailing edge 17; a curved portion 24 extending from the end of the first portion 23 and which curves back over the first portion 23, preferably forming an arc greater than 180° degrees; and a second planar portion 25 extending from the end of the curved portion 24 and which is essentially parallel to the first portion 23 and trailing edge 17, but which is closer to the first portion 23 than the outer most portions of the curved portion 24. These elements combine to define a cavity 26 which is capable of engaging a sealing member 27 in position as shown, which sealing member 27 may be formed of a variety of appropriate sealing materials including various plastics and rubbers. The terminating edge 28 of the sealing member 27 preferably extends beyond the terminating end 21 of the trailing edge 17 so that the sealing member 27 is capable of contacting opposing face portions 34 of the damper structure which are located adjacent the leading edge 17 of the blade 3. In this manner, a substantial seal is developed between the respective blades 3, as well as between the lowermost blade 3 and the flange 6, substantially sealing the resulting structure when the blades 3 are in the closed position.

Again referring to FIG. 4, the leading edge 18 depends outwardly and downwardly from the remaining edge 20 of the face portion 16, as will be more fully described below, and terminates at the hinge 9 previously described.

It will be understood that the foregoing structural elements may be formed in an variety of ways, and that each blade 3 may be readily formed as a unitary element from conventional construction materials. Thus, the aerodynamic shape 15 of each blade 3 may be formed simply and inexpensively using essentially conventional techniques.

The resulting structure will combine to develop an aerodynamic shape 15 which creates the two air flow pads 29, 30 illustrated in FIG. 4, the air path 29 essentially extending over the face portion 16 of the blade 3 and the air path 30 essentially progressing beneath the face portion 16 and within the inverted, pan-shaped cavity 31 defined by the face portion 16 and the leading and trailing edges 18, 17, respectively. The differential which is produced as air flows along air paths 29, 30, as illustrated, will create lift which will in turn develop a force capable of assisting the blades to open as air passes through the damper 1. Since the aerodynamic shape 15 of the present invention is configured to respond not only to relatively high speed air flows, but also to relatively low speed air flows, improved results are achieved regardless of the actual air flow rate encountered through the damper 1, as will be illustrated more fully hereinafter with reference to FIG. 5. Moreover, such results will be achieved even though the heavier materials which are traditionally used to construct the damper blades of such dampers are used, maintaining the structural integrity of the damper blades 3 without sacrificing damper efficiency. Improved results will similarly be provided as the weight of such damper blades is increased or decreased to suit a particular application.

It will be understood that the air flow characteristic developed may be varied in accordance with the present invention by altering the various dimensions of the respective elements comprising the aerodynamic shape 15. However, with reference to FIG. 4, the following dimensional relationships are preferred to achieve satisfactory results in conjunction with backdraft dampers of the type previously described.

(1) The length $L_0$ of the face portion 16 will generally comprise approximately 83.75% of the total length $L_1+L_0+L_2$ of each blade 3 (taken from the hinge 9 to the end 21 of the trailing edge 17).

(2) The length $L_1$ and height $H_1$ of the leading edge 18 will generally comprise approximately 10% of the total length of each blade 3 (causing the depending leading edge 18 to assume an angle of approximately 135° with respect to the surface portion 16).

(3) The length $L_2$ of the trailing edge 17 will generally comprise approximately 6.25% of the total length of each blade 3 while the height $H_2$ of the trailing edge 17 will generally comprise approximately 8.75% of the total length of each blade 3.

Figure 5:
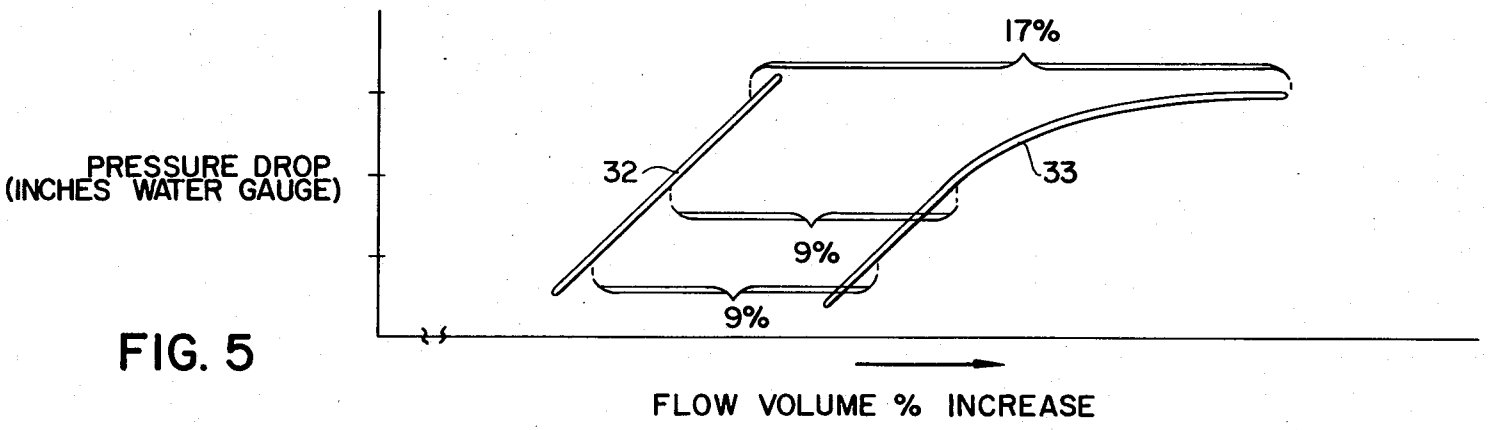
FIG. 5 is a graph which illustrates the improved flow characteristics developed through a damper which incorporates blades having the aerodynamic shape of the present invention.

Irrespective of the precise configuration used, it can be expected that a backdraft damper incorporating damper blades having the aerodynamic shape of the present invention will exhibit a significant improvement over prior art devices. FIG. 5 has been provided to graphically illustrate the order of magnitude of the improvement which can be expected, the reference line 32 showing the variation between pressure drop and flow volume percent increase the existing devices, and the reference line 33 showing such the variation between pressure drop and flow volume percent incease which can be expected for backdraft dampers incorporating blades having the aerodynamic shape of the present invention. As will be noted, even when relatively low air flow rates are encountered, a significant increase in performance (on the order of 9%) will be achieved. For increased flow rates, this improvement is still further increased (to approximately 17%). It will therefore be seen that the aerodynamic shape of the present provides a significant improvement over prior art devices of this type. This is so even if not all of the blades of the damper are provided with the aerodynamic shape of the present invention, which may be desirable in certain circumstances.

Figure 6:
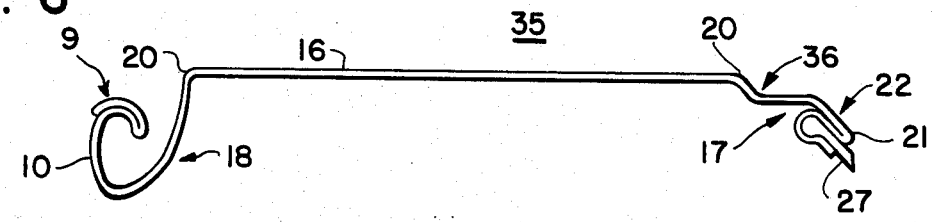
FIG. 6 is a cross-sectional view of an alternative embodiment aerodynamic shape in accordance with the present invention.

It will also be understood that the aerodynamic shape 15 of the present invention is capable of variation without departing from the spirit and scope of the present invention. For example, FIG. 6 illustrates one such alternative embodiment aerodynamic shape 35. As will be noted, the majority of the aerodynamic shape 35 substantially corresponds to the configuration of the aerodynamic shape 15, but for the offset portion 36 shown. Other variations of the present invention are also possible.

Moreover, it will be readily understood that the aerodynamic shape of the present invention is not only applicable to backdraft dampers, but is also applicable to other types of dampers as well. Further, it will be understood that the aerodynamic shape of the present invention will also find applicability in arts not relating to the construction of air dampers, but rather is adaptable to any situation requiring an aerodynamic shape which provides significant lift characteristics, particularly when air flow rates of relatively low speed are to be encountered. For this reason, the aerodynamic shape of the present invention will also find applicability in conjunction with sails used in boating applications, lift bodies and wings, as well as blades and vanes used in conjunction with wind mills or other forms of thermal energy collection. Other uses for aerodynamic shapes 15, 35 may also be developed in accordance with the present invention.

It will therefore be understood that various changes in the details, materials and arrangements of parts which have been herein described and illustrated in order to explain the nature of this invention may be made by those skilled in the art within the principle and scope of the invention as expressed in the following claims.

What is claimed is:

1. For a damper including a plurality of blades having a predetermined cross-sectional length pivoted for rotation within a peripherally disposed damper frame between a closed position and an open position in response to the movement of air through the damper, an aerodynamically improved damper blade comprising:

(a) a centrally disposed, essentially planar face portion having first and second opposing longitudinal edges, the length of said central portion from said first edge to said second edge comprising approximately 83.75% of the cross-sectional length of the blade;

(b) a leading depending member associated with said first longitudinal edge of the face portion, depending outwardly from the first longitudinal edge of the face portion forming a first angle with respect to the face portion, said leading depending member comprising approximately 10% of the cross-sectional length of the blade and having a height equal to approximately 10% of the cross-sectional length of the blade; and (c) a trailing depending member associated with said second longitudinal edge of the face portion, depending outwardly from the second longitudinal edge of the face portion forming a second angle with respect to the face portion, said trailing member comprising approximately 6.25% of the cross-sectional dimension of the blade and having a height less than the height of said leading depending member, such that that the central face portion and leading and trailing members combine to define a cross-sectionally inverted, pan-shaped enclosure when the blade is in its open position.

2. The damper blade of claim 1 wherein the trailing depending member includes sealing means for sealingly engaging other portions of the damper when the damper blade is in the closed position.

3. The damper blade of claim 2 wherein the sealing means are located along the terminating edge of the trailing depending member.

4. The damper blade of claim 2 wherein the sealing means are retained to the trailing depending member by engaging means comprising:

(a) a first portion associated with the terminating edge of the trailing depending member, and folded back upon the trailing depending member;

(b) a curved portion associated with the terminating end of the first portion, which curves back over the first portion and forms an arc of not less than 180°; and (c) a second portion associated with the teminating end of the curved portion, which extends over and is spaced away from the first portion.

5. The damper blade of claim 1 wherein the leading depending member includes hinge means for pivotally engaging the damper frame.

6. The damper blade of claim 1 wherein the lateral edges of the face portion rest on a peripheral flange associated with the damper frame, wherein the terminating edge of the trailing depending member includes sealing means for engaging other portions of the damper when the blade is in the closed position, wherein the terminating edge of the leading depending member includes hinge means for pivotally engaging the damper frame, and wherein the damper blade and damper frame combine to develop a substantial seal when the damper blade is in the closed position.

7. The damper blade of claim 1 wherein the damper blade is capable of opening to a position wherein the damper blade is susbstantially parallel to the flow of air through the damper.

8. The damper blade of claim 7 wherein the damper includes a plurality of damper blades, and wherein the plurality of damper blades are interconnected to open and close substantially simultaneously.

9. The damper blade of claim 1 wherein the thickness of the damper blade is on the order of 0.020 inches.

10. The damper blade of claim 1 wherein the aerodynamic shape develops two air paths which respectively proceed over and under the damper blade in the open position, and wherein the two air paths combine to produce a differential which develops lift for raising the damper blade.

11. The damper blade of claim 10 wherein the lift is developed for both low and high air velocities through the damper.

12. An aerodynamically shaped damper blade according to claim 1 wherein:

said trailing member has a height equal to approximately 8.75% of the cross-sectional length of said blade.

13. An aerodynamically shaped damper blade according to claim 12 wherein:

said leading member projects from said face portion at an angle of approximately 135°.

14. An aerodynamically shaped body having a predetermined cross-sectional length comprising:

(a) a centrally disposed, essentially planar face portion having first and second opposing longitudinal edges, the length of said central portion from said first edge of said second edge comprising approximately 83.75% of the cross-sectional length of said body;

(b) a leading depending member associated with said first longitudinal edge of the face portion, diverging outwardly from the first longitudinal edge of the face portion and forming a first angle with respect to the face portion, said leading depending member comprising approximately 10% of the cross-sectional length of said body and having a height equal to approximately 10% of the cross-sectional length of said body; and (c) a trailing depending member associated with said second longitudinal edge of face portion, diverging outwardly from the second longitudinal edge of the face portion and forming a second angle with respect to the face portion, said trailing member comprising approximately 6.25% of the cross-sectional length of said body and having a height less than the height of said leading member such that the face portion and said leading and trailing members conbine to define a cross-sectionally inverted, pan-shaped enclosure when air is directed theretowards.

15. An aerodynamically shaped body according to claim 14 wherein:

said trailing member has a height equal to approximately 8.75% of the cross-sectional length of said body.

16. An aerodynamically shaped body according to claim 15 wherein:

said leading member projects from said face portion at an angle of approximately 135°.

17. An improved damper having a plurality of blades having a predetermined cross-sectional length pivoted for rotation within a peripherally disposed damper frame between a closed position and a fully open position in response to the movement of air through the damper, the improved damper comprising:

means for increasing the volume of airflow through the damper and thereby decreasing the force of air required to pivot the blades to their fully open position including at least one blade having:

(a) a centrally disposed, essentially planar face portion having first and second opposing longitudinal edges, the length of said central portion from said first edge of said second edge comprising approximately 83.75% of the cross-sectional length of the blade;

(b) a leading member associated with said first longitudinal edge of the face portion, depending outwardly form the first longitudinal edge of the face portion forming a first angle with respect to the face portion, said leading member comprising approximately 10% of the cross-sectional length of approximately 10% of the cross-sectional length of the blade; and (c) a trailing member associated with said second longitudinal edge of the face portion depending outwardly from the second longitudinal edge of the face portion forming a second angle with respect to the face portion, said trailing member comprising approximately 6.25% of the cross-sectional length of the blade and having a height less than the height of the leading member such that the face portion and first and second depending members combine to define a cross-sectionally inverted, pan-shaped enclosure when the blade is in its open position.

18. An improved damper according to claim 17 wherein:

said trailing member has a height of approximately 8.75% of the cross-sectional length of said blade.

19. An improved damper according to claim 18 wherein:

said leading member projects from said face portion at an angle of approximately 135°.

20. An improved damper according to claim 19 wherein:

all blades of the damper are similarly, efficiently, aerodynamically shaped.

* * * * *

UNITED STATES PATENT AND TRADEMARK OFFICE

CERTIFICATE OF CORRECTION

PATENT NO. : 4,655,122

DATED : April 7, 1987

INVENTOR(S) : Francis J. McCabe

It is certified that error appears in the above-identified patent and that said Letters Patent is hereby corrected as shown below:

Column 2, line 35, delete "conjucntion" and insert therefor--conjunction--.

Column 6, line 21, delete "the" before the word "existing" and insert therefor--for--.

Claim 17, line 19, delete "form" and insert therefor--from--.

Claim 17, line 23, between "of" and "approximately" insert--the blade and having a height equal to--.

Signed and Sealed this

Eighteenth Day of August, 1987

*Attest:*

DONALD J. QUIGG

*Attesting Officer*

*Commissioner of Patents and Trademarks*